106-18.16 SR

XR 3,997,699

United States

1] 3,997,699

Sistrunk

5] Dec. 14, 1976

[54] FLAME RESISTANT SUBSTRATES

[75] Inventor: Thomas O. Sistrunk, Southfield, Mich.

[73] Assignee: Ethyl Corporation, Richmond, Va.

[22] Filed: Apr. 25, 1975

[21] Appl. No.: 571,738

[52] U.S. Cl. ..... 428/276; 8/115.7; 8/116 P; 106/15 FP; 260/551 P; 427/372 R; 427/394; 427/402; 428/480; 428/532; 428/DIG. 921

[51] Int. Cl.[2] ..... D06M 13/44; B32B 27/36

[58] Field of Search ..... 428/276, 921, 480, 532; 8/116 P, 115.7; 106/15 FP; 260/551 P; 252/8.1; 427/372, 394, 402

[56] References Cited

UNITED STATES PATENTS

| | | | |
|---|---|---|---|
| 2,648,597 | 8/1953 | Nielsen | 106/15 X |
| 2,661,311 | 12/1953 | Jenkins | 428/276 |
| 2,666,750 | 1/1954 | Dickey et al. | 260/551 X |
| 3,075,011 | 1/1963 | Garner et al. | 260/551 |
| 3,478,095 | 11/1969 | Normant | 260/551 |
| 3,650,819 | 3/1972 | Weyker | 428/276 X |
| 3,660,582 | 5/1972 | DiPietro et al. | 106/15 X |
| 3,712,789 | 1/1973 | Linderman et al. | 8/116 P |
| 3,816,068 | 6/1974 | Rivlin | 8/115.7 |
| 3,829,289 | 8/1974 | Tesoro | 8/115.7 |
| 3,852,947 | 12/1974 | Mayer | 57/140 |

FOREIGN PATENTS OR APPLICATIONS

| | | | |
|---|---|---|---|
| 775,146 | 1/1968 | Canada | 252/551 |
| 1,811,351 | 6/1970 | Germany | |

*Primary Examiner*—P. E. Willis, Jr.
*Attorney, Agent, or Firm*—Donald L. Johnson; John F. Sieberth; James M. Pelton

[57] ABSTRACT

A flame resistant substrate composed of cotton and flame retardant polyester fibers having a flame retardant affixed thereto and a method for increasing the flame resistance of a substrate composed of cotton and flame retardant polyester fibers.

35 Claims, No Drawings

3997699

FLAME RESISTANT SUBSTRATES

BACKGROUND OF THE INVENTION

Fabrics comprising blends of cotton with polyester fibers are of considerable commercial importance because of their widespread use in apparel. However, such fabrics are highly flammable. To reduce the flammability of such blends, a flame retardant must be applied to the fabric. A flame retardant is a substance which increases the resistance of a substrate to burning or charring. Flame retardants are known for 100 percent cotton fabrics, but researchers in this field have concluded that the flammability of blend fabrics cannot be predicted from knowledge of the flammability of fabrics made from a single fiber, G. C. Tesoro, Status and Prospects for Flame Resistant Polyester/Cellulose Blend Fabrics, National Bureau of Standards Report COM-73-11265, March, 1973. One important reason for this unpredictability of blend fabrics, e.g., cotton/-polyester blends, is the so-called "grid" or "scaffold" effect by which one component of the blend forms a supporting matrix for continued burning of the other component. With regard to this effect, W. Kruse reported:

> "In all textile mixtures containing a component capable of forming a structural network (e.g. cotton) and a thermoplastic component (e.g. polyester) account must be taken of the scaffold effect, as it substantially alters the combustion behavior of thermoplastic synthetic fibers.
>
> "In mixed textiles the framework is built in all cases by organic material. Interestingly enough, it is also possible to arrive at a scaffold effect with inorganic material if, for instance, single component fabrics of thermoplastic fibers are given a framework forming finish (e.g. silicate)." W. Kruse, Melliand Textilber, April 1969, pp. 460–469 (Gottlieb Duttweiler Institute Publication No. 45, pp. 137–161, 1969), Combustibility and Flame Resistant Finishing of Mixed Textiles.

In accordance with existing technology, polyester fibers can be flame retarded. In one method, a brominated component, tetrabromobisphenol-A ethoxylate, is incorporated in the polymerization reaction producing the polyester from which the fiber is spun. In another method, a polyester fiber is treated topically with an aqueous dispersion of tris-(2,3-dibromopropyl)-phosphate which, at elevated temperature, undergoes a thermally induced diffusion into the polyester fiber, thereby reducing the flammability of the fiber.

Polyester fibers having tetrabromobisphenol-A ethoxylate incorporated therein or treated with tris-(2,3-dibromopropyl)phosphate are themselves flame retardant, but when blended with cotton the fire retardance of the polyester is insufficient to render the blend flame retardant. It has now been found that treatment according to the present method significantly increases the resistance of such blends of cotton/flame retardant polyester fibers to flame and provides a material which is significantly more flame retardant than presently known materials.

THE INVENTION

In accordance with the present invention, there is provided a flame resistant substrate of cotton and flame retardant polyester fibers, the fibers having phosphorus-containing flame retardant affixed thereto, the phosphorus-containing flame retardant being a compound of the formula

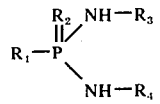

where $R_1$ is methyl, ethyl, propyl, phenyl, $ClH_2$ or $BrCH_2$; $R_2$ is oxygen or sulphur; $R_3$ is hydrogen, methyl, ethyl or propyl, and $R_4$ is hydrogen, methyl, ethyl or propyl.

Also in accordance with the present invention, there is provided a method for increasing the flame resistance of a substrate composed of cotton and flame retardant polyester fibers including coating the fibers with a phosphorus-containing flame retardant, the phosphorus-containing flame retardant being a compound of the formula

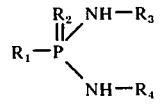

where $R_1$ is methyl, ethyl, propyl, phenyl, $ClCH_2$ or $BrCH_2$; $R_2$ is oxygen or sulphur; $R_3$ is hydrogen, methyl, ethyl or propyl, and $R_4$ is hydrogen, methyl, ethyl or propyl, drying the substrate, and curing the substrate. The flame retardant can be applied to the cotton polyester substrate from an aqueous solution by a standard pad, cure and after wash procedure, or in any other conventional manner.

The polyester fibers may be made by any process well known in the art. The polyester fibers may be flame retarded with well known flame retardants which are conventional in the art. Especially preferred is a polyester fiber component which is flame retarded with a bromine-containing flame retardant compound and most preferable is the polyester having tetrabromobisphenol-A ethoxylate incorporated therein. The fabric may contain from 15% to 85% polyester by weight, the remainder being cotton. Preferably, the fabric may contain from about 35% to about 75% polyester by weight. More preferably, the fabric may contain from about 45% to about 65% polyester by weight. A most especially preferred polyester/cotton blend is a 50/50 weight percent blend.

The phosphorus-containing flame retardants used in the present invention are those compounds having the general formula

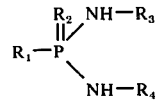

where $R_1$ is methyl, ethyl, propyl, phenyl, $ClCH_2$ or $BrCH_2$; $R_2$ is oxygen or sulphur; $R_3$ is hydrogen, methyl ethyl or propyl, and $R_4$ is hydrogen, methyl, ethyl or propyl. Preferred flame retardants are those where $R_1$ is an ethyl or methyl group, and $R_3$ and $R_4$ are hydrogen atoms. The most preferred is a compound in which $R_1$ is a methyl group, $R_2$ is oxygen, and $R_3$ and $R_4$ are hydrogen atoms, i.e., methyl phosphonic diamide, hereinafter abbreviated as MPDA. MPDA can be prepared according to the method of Ratz, *J. Am. Chem. Soc.*, 77 4170 (1955), which is hereby incorporated by reference as if fully set forth. Certain halomethyl phosphonic acid bisamides have previously been disclosed as flame retardants in Dutch Patent Publication No. 66/5,460. In addition, flame retardants containing the

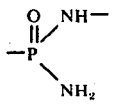

group have been disclosed in U.S. Pat. No. 2,648,597, which is hereby incorporated by reference.

Preferably the phosphorous-containing flame retardant is 100% pure, but various other compounds such as salts may be intermixed with the phosphorus-containing flame retardants when produced commercially. Preferbly, such compounds are water soluble so that they can be easily removed from the substrate by washing. For example, salts such as ammonium chloride, sodium chloride, and the like, may be intermixed with the flame retardant. Such compounds are by-products of one process by which the phosphorus-containing flame retardant can be made, and because of the difficulty in separating them from the flame retardant, it is convenient to have them intermixed therewith. They are permissible and do not detract from the advantages of the present invention. Such other compounds may be intermixed with the flame retardant in amounts of up to about 150% of the flame retardant by weight, more preferably, in amounts of up to about 120% of the flame retardant by weight.

The amount of phosphorus-containing flame retardant may be varied in accordance with the degree of flame retardance desired. The amount of flame retardant is expressed as a percentage which is determined by dividing the weight of the flame retardant solid on the treated fabric by the weight of the untreated fabric and multiplying the quotient by 100. Such a percentage is hereinafter referred to as percent dry add on (and is abbreviated percent DAO). The percent dry add on of the phosphorous-containing flame retardant may vary from about 2% to about 35%, preferably from about 5% to about 20%, and more preferably, from about 7% to about 15%.

The solution with which the cotton polyester substrates are treated contains from about 5% by weight to about 30% by weight of the phosphorus-containing flame retardant, the remainder being water. More preferably, the treating solution contains from about 15% by weight to about 25% by weight of the phosphorus-containing flame retardant, the remainder being water.

The cotton/polyester substrate may be treated or impregnated with a solution of the phosphorus-containing flame retardant, by dipping the substrate into the solution of the phosphorus-containing retardant or by spraying or padding the solution of such flame retardant on the substrate and allowing the substrate to dry. The solution of such flame retardant may also be applied by spraying, dipping, padding, or the like. After the solution of such flame retardant has been applied, the substrate is dried by any conventional means known in the art.

After drying, the substrates are then cured by heating at a temperature sufficiently high enough and for sufficient time to firmly bond the phosphorus-containing flame retardant to the substrate. Curing preferably is carried out at a temperature of from about 330° to about 360° F for a period of from about ½ minute to about 5 minutes, or more preferably at a temperature of from about 340° to about 350° F for a period of from about ½ minute to about 1½ minutes. After curing, the substrates may be washed to remove any salt such as ammonium chloride or sodium chloride which may be on the fabrics. After washing the substrates are then redried as in the previous drying.

Several fabrics composed of cotton/polyester blends were treated by dipping the fabric into a solution of the phosphorus-containing flame retardant followed by drying, curing, washing and redrying. The fabrics were then tested according to the procedure of Department of Commerce flammability test FF 3-71. The results are shown in the following table. In the table, the following explanations are used:

1. Fabric
   A. 50% cotton/50% woven polyester (by weight) blend fabric, 2.6 oz/yd$^2$, in which the polyester fiber was made flame retardant prior to making the fabric by incorporating a bromine-containing compound.
   B. 35% cotton/65% polyester blend of materials of Fabric A.
2. Treating Solution
   I. One part crude MPDA (47% MPDA, 53% $NH_4Cl$) and two parts water. Parts and percentages by weight.
   II. Two parts crude MPDA (47 % MPDA, 53% $NH_4Cl$) and three parts water. Parts and percentages by weight.
3. Drying and Curing Conditions
   Where drying is indicated, the fabric was dried at 90° C to constant weight.
   Where curing is indicated, the fabric was heated at 340°–350° F for 1 minute.
4. MPDA Efficiency
   This term refers to the weight increase of the fabric because of fire retardant treatment divided by the weight of MPDA in the treating solution absorbed by the fabric multiplied by 100.
5. Vertical Flame Test
   The test employed was the procedure of Department of Commerce flammability test FF 3-71. W refers to samples tested in the warp direction. F refers to samples tested in the fill direction. BEL is an acronym meaning burned entire length of the 10-inch specimen. Data are given in the table in the following order: (1) direction of test — W or F meaning warp or fill; (2) char length, in inches; and (3) time of burning, in seconds, e.g., W 4.8 25. The samples were tested as produced and the results indicate initial values.

The following examples, presented in tabular form, should be considered illustrative of the invention and non-limiting. Unless otherwise indicated, all parts and percentages are by weight.

Although acceptance criteria for Flammability Test DOC FF 3-71 require that the average char length for 5 specimens be less than 7 inches and no specimen burns the entire length (BEL), when a BEL result is obtained the burning time is an important indication of relative difficulty of burning compared to other specimens also having BEL results. Thus, when two specimens are reported as "BEL", the one with a longer burning time is considered relatively more resistant to flame. Therefore, specimens of the present invention which burn the entire length can be considered more flame resistant, based on burning time, than the comparative specimens. For example, the specimens of Example 4, having BEL results with burning times of 23 and 21 seconds would be considered more resistant to flame than the comparative specimens, all of which gave BEL results and burned more than twice as fast, i.e., from 9–13 seconds. However, it should be noted that burning time is not considered of relative importance if the specimen did not burn the entire length.

TABLE OF EXAMPLES

| Example No. | 1 | | 2 | 3 | 4 | 5 |
|---|---|---|---|---|---|---|
| Fabric | A | | A | A[1] | A | B |
| Dry Weight, g | 38.6 | | 10.5 | 13.7 | 27.0 | 41.4 |
| Wet Weight, g | 73.9 | | | 27.2 | 54.3 | 75.1 |
| Wet Pick-up, wt % | 92 | | | 99 | 101 | 81 |
| Dry Weight, g | 50.3 | | 13.9 | 18.5 | 37.4 | 54.5 |
| Redry Weight, g | 50.4 | | 14.0 | | 37.4 | 54.5 |
| Post Cure Weight, g | 49.7 | | 13.6 | 18.2 | 36.5 | 53.7 |
| Weight After Wash and Dry, g | 41.1 | | 11.2 | 14.8 | 28.8 | 43.6 |
| Redry Weight, G | — | | 11.2 | 14.8 | | |
| % DAO, MPDA | 6.5 | | 6.2 | 7.0 | 6.6 | 5.3 |
| Analysis, % Phosphorus | 2.03 | | 2. | 2.57 | 2.66 | 1.75 |
| % Bromine | 3.30 | | 2 | 3.07 | 3.26 | 4.22 |
| MPDA Efficiency, % | 45 | | — | 52 | 40 | 39 |
| Treating Solution | I | | I | I | I | I |
| | | (2nd Series) | | | | |
| Vertical Flame Test | W 4.8 25 | W 5.0 25 | W 4.5 22 | W 3.5 3 | 3.8 18 | BEL 34 |
| | W 6.9 39 | W 3.9 21 | W 4.1 17 | W 6.0 18 | 4.3 18 | BEL 31 |
| | W 5.6 29 | W 5.7 28 | W 4.6 25 | W 6.3 18 | BEL 23 | BEL 31 |
| | W 3.7 20 | W 4.9 28 | | | BEL 21 | BEL 32 |
| | F BEL 18 | F 5.1 27 | | | 4.4 18 | BEL 33 |

[1]Same as Fabric A, except knit construction at 3.7 oz/yd[2].
[2]Analysis originally performed was erroneous; additional fabric sample unavailable for reanalysis; original fabric Br wt % range is 3.3–3.6%.

For comparative purposes, samples not in accord with this invention were tested in the Vertical Flame Test for initial results. One sample used a blend of 50% cotton, 50% polyester, by weight, blend without treatment. All specimens burned the entire length within 12-13 seconds. Another sample was the same Fabric A described hereinabove as a 50% cotton/50% polyester in which the polyester has been flame retarded with a bromine-containing compound, but without treatment according to this invention. All specimens burned the entire length in 9–10 seconds.

What is claimed is:

1. A flame resistant substrate comprising cotton and polyester fibers, said polyester fibers having incorporated therein tetrabromobis-phenal-A ethoxylate flame retardant, and said substrate having affixed thereto a flame retardant amount of a phosphorous-containing flame retardant compound of the formula

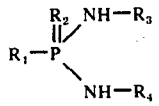

where $R_1$ is methyl, ethyl, propyl, phenyl, $ClCH_2$ or $BrCH_2$; $R_2$ is oxygen or sulphur; $R_3$ is hydrogen, methyl, ethyl or propyl; and $R_4$ is hydrogen, methyl, ethyl or propyl.

2. The substrate of claim 1 wherein said substrate contains from about 15% to about 85% by weight polyester, the remainder being cotton.

3. The substrate of claim 1 wherein said substrate contains about 35% to 75% polyester by weight, the remainder being cotton.

4. The substrate of claim 1 wherein said substrate contains from about 45% to about 65% polyester by weight, the remainder being cotton.

5. The substrate of claim 1 wherein said $R_1$ is an ethyl or methyl group and $R_3$ and $R_4$ are hydrogen atoms.

6. The substrate of claim 1 wherein said $R_1$ is a methyl group, said $R_2$ is oxygen and said $R_3$ and $R_4$ are hydrogen atoms.

7. The substrate of claim 1 wherein the amount of said phosphorus-containing flame retardant compound, measured as percent dry add on, is from about 2% to about 35%.

8. The substrate of claim 7 wherein a water soluble compound selected from ammonium chloride and sodium chloride is intermixed with said phosphorus-containing flame retardant.

9. The substrate of claim 8 wherein said water soluble compound is ammonium chloride.

10. The substrate of claim 9 wherein said ammonium chloride is present in an amount of up to about 150% of said phosphorus-containing flame retardant compound, by weight.

11. The substrate of claim 1 wherein the amount of said phosphorus-containing flame retardant compound, measured as percent dry add on, is from about 5% to about 20%.

12. The substrate of claim 1 wherein the amount of said phosphorus-containing flame retardant compound, measured as percent dry add on, is from about 7% to about 15%.

13. A flame resistant substrate of cotton and polyester fibers, said substrate comprising about 35% to about 75% polyester by weight, said polyester fibers having incorporated therein tetrabromobis-phenol-A ethoxylate flame retardant, the remainder being cotton, said fibers having a phosphorus-containing flame retardant compound affixed thereto, the amount of said phosphorus-containing flame retardant compound, measured as percent dry add on, being from about 2% to about 35%, said phosphorus-containing flame retardant comprising a compound of the formula

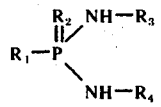

wherein $R_1$ is methyl, ethyl, propyl, phenyl, $ClCH_2$ or $BrCH_2$; $R_2$ is oxygen or sulphur; $R_3$ is hydrogen, methyl, ethyl or propyl, and $R_4$ is hydrogen, methyl, ethyl or propyl.

14. The substrate of claim 13 wherein said $R_1$ is an ethyl or methyl group and said $R_3$ and $R_4$ are hydrogen atoms.

15. The substrate of claim 13 wherein said $R_1$ is a methyl group, said $R_2$ is oxygen and said $R_3$ and $R_4$ are hydrogen atoms.

16. The substrate of claim 13 wherein a water soluble compound selected from ammonium chloride and sodium chloride is intermixed with said phosphorus-containing flame retardant.

17. The substrate of claim 13 wherein said water-soluble compound is ammonium chloride.

18. A method for increasing the flame resistance of a substrate of cotton and polyester fibers, said polyester fibers having incorporated therein a tetrabromobisphenol-A ethoxylate flame retardant, comprising treating said fibers with a phosphorus-containing flame retardant, said phosphorus-containing flame retardant comprising a compound of the formula

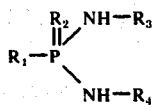

where $R_1$ is methyl, ethyl, propyl, phenyl, benzyl, $ClCH_2$ or $BrCH_2$; $R_2$ is oxygen or sulphur; $R_3$ is hydrogen, methyl, ethyl or propyl, and $R_4$ is hydrogen, methyl, ethyl or propyl, and curing the substrate.

19. The method of claim 18 wherein said substrate is washed after curing to remove water soluble compounds selected from ammonium chloride and sodium chloride therefrom.

20. The method of claim 18 wherein said treating comprises coating said substrate with a solution comprising from about 5% by weight to about 30% by weight of said phosphorus-containing flame retardant, the remainder being water.

21. The method of claim 18 wherein said curing comprises heating said substrate to a temperature of from about 330° F to about 360° F for a period of from about ½ minute to about 5 minutes.

22. The substrate of claim 18 wherein said substrate contains from about 15% to about 85% by weight polyester, the remainder being cotton.

23. The substrate of claim 18 wherein said $R_1$ is an ethyl or methyl group and $R_3$ and $R_4$ are hydrogen atoms.

24. The substrate of claim 18 wherein said $R_1$ is a methyl group, said $R_2$ is oxygen and said $R_3$ and $R_4$ are hydrogen atoms.

25. The substrate of claim 18 wherein a water soluble compound selected from ammonium chloride and sodium chloride is intermixed with said flame retardant.

26. The substrate of claim 25 wherein said water soluble compound is ammonium chloride.

27. The substrate of claim 26 wherein said ammonium chloride is present in an amount of up to about 150% of said phosphorus-containing flame retardant, by weight.

28. A method for increasing the flame resistance of a substrate of cotton and polyester fibers, said polyester fibers having incorporated therein a tetrabromobisphenol-A ethoxylate flame retardant, said substrate comprising from about 35% to about 75% polyester by weight, the remainder being cotton, comprising treating said substrate with a solution of a phosphorus-containing flame retardant, said solution comprising from about 5% by weight to about 30% by weight of said phosphorus-containing flame retardant, the remainder being water, said phosphorus-containing flame retardant comprising a compound of the formula

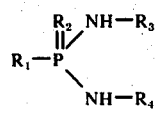

where $R_1$ is methyl, ethyl, propyl, phenyl, $ClCH_2$ or $BrCH_2$; $R_2$ is oxygen or sulphur; $R_3$ is hydrogen, methyl, ethyl or propyl, and heating said compound to a sufficient temperature for a time sufficient to cure said flame retardant.

29. The method of claim 28 in which said phosphorus-containing flame retardant compound is further defined by said $R_1$ being ethyl or methyl and said $R_3$ and $R_4$ being hydrogen.

30. The method of claim 28 in which said phosphorus-containing flame retardant compound is further defined as having said $R_1$ being a methyl group, said $R_2$ being oxygen and said $R_3$ and $R_4$ being hydrogen atoms.

31. The method of claim 28 wherein a water soluble compound selected from ammonium chloride and sodium chloride is intermixed with said flame retardant.

32. The method of claim 31 wherein said water soluble compound is ammonium chloride.

33. The method of claim 31 wherein said ammonium chloride is present in an amount of up to about 150% of said flame retardant, by weight.

34. The method of claim 31 wherein said substrate is washed after curing to remove said water soluble compound therefrom.

35. The method of claim 28 wherein said temperature is from about 330° F to about 360° F and said time is from about ½ minute to about 5 minutes.

* * * * *

UNITED STATES PATENT OFFICE

CERTIFICATE OF CORRECTION

PATENT NO. : 3,997,699

DATED : December 14, 1976

INVENTOR(S) : Thomas O. Sistrunk

It is certified that error appears in the above-identified patent and that said Letters Patent are hereby corrected as shown below:

Col. 2, line 35, "pad, cure" should read -- pad, dry cure-- Col. 5, Table of Examples, under Example No. 2, lines 12 and 13, reads "2" should read --$^2$--. Col. 5, line 51, "phenal" should read -- phenol --.

Signed and Sealed this

Fifth Day of April 1977

[SEAL]

*Attest:*

RUTH C. MASON
*Attesting Officer*

C. MARSHALL DANN
*Commissioner of Patents and Trademarks*